US007274251B2

(12) United States Patent
Yang

(10) Patent No.: US 7,274,251 B2
(45) Date of Patent: Sep. 25, 2007

(54) APPARATUS AND METHOD OF CURRENT SHARING

(75) Inventor: Ta-yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 11/195,067

(22) Filed: Aug. 1, 2005

(65) Prior Publication Data

US 2007/0024263 A1 Feb. 1, 2007

(51) Int. Cl.
*G05F 1/10* (2006.01)

(52) U.S. Cl. ..... 327/543; 323/312; 323/315

(58) Field of Classification Search ..... 323/312–316, 323/280–282, 907, 266, 278; 327/538–541
See application file for complete search history.

(56) References Cited

U.S. PATENT DOCUMENTS 3,753,078 A * 8/1973 Hedel ..... 323/277

3,959,713 A * 5/1976 Davis et al. ..... 323/278

* cited by examiner

*Primary Examiner*—Rajnikant B. Patel
(74) *Attorney, Agent, or Firm*—J.C. Patents

(57) ABSTRACT

A current sharing apparatus and a method thereof are provided. The current sharing apparatus comprises an input terminal, an output terminal, a current-sharing control terminal, a pass transistor, a constant voltage generating unit, a feedback control circuit and a current-sharing control unit. The current-sharing control terminal provides a current-sharing control interface. The pass transistor receives an input voltage and provides an output voltage and an output current. The feedback control circuit senses the output current to provide a current-sense signal and regulates a control signal of the pass transistor for controlling an output of the current-sharing apparatus. Moreover, the current-sharing control unit electrically coupled to the current-sharing control terminal and the feedback control circuit generates a bus signal in response to the current-sense signal and a reference voltage and generates a reference signal in response to the reference voltage, the bus signal and the current-sense signal.

22 Claims, 8 Drawing Sheets

APPARATUS AND METHOD OF CURRENT SHARING

BACKGROUND OF THE INVENTION

1. Field of the Invention

The present invention relates to a current-sharing apparatus and a method thereof, and more particularly, to a current-sharing apparatus for automatically regulating the respective current-sharing amount and a method thereof.

2. Description of the Related Art

In general, the lifespan of an electronic element is significantly correlated to its operating temperature. The operating temperature also varies in direct proportion to a current flowing across the electronic element. For example, when an input voltage of a voltage regulator is very high, an output current and a voltage drop of the voltage regulator inevitably generate a certain amount of power consumption. Such power consumption increases the operating temperature of the voltage regulator.

The voltage regulator is commonly applied in the power management system of various electronic products for providing a regulated electrical power. FIG. 1 schematically shows a circuit diagram of a conventional voltage regulator. The voltage regulator comprises an unregulated DC input voltage $V_{IN}$, a pass transistor 10, a regulated DC output voltage $V_O$ and a voltage divider composed of resistors 31 and 32. In addition, the voltage regulator further comprises a feedback control circuit electrically coupled to the pass transistor 10. Moreover, the feedback control circuit comprises an error amplifier 20 and a reference voltage $V_{REF}$ generated by a constant voltage generating unit 40. The feedback control circuit is electrically coupled to the DC output voltage $V_O$ via the voltage divider, and the resistors 31 and 32 are connected in series between the regulated DC output voltage $V_O$ and a ground reference. A joint of the resistors 31 and 32 is electrically coupled to a positive terminal of the error amplifier 20, and the reference voltage $V_{REF}$ is electrically coupled to a negative terminal of the error amplifier 20. In addition, an output terminal of the error amplifier 20 is electrically coupled to a gate of the pass transistor 10. Moreover, the feedback control circuit controls the impedance of the pass transistor 10 by modulating a gate voltage of the pass transistor 10. Currents with different levels are provided to an output terminal of the voltage regulator by the pass transistor 10 in response to the gate voltage of the pass transistor 10. Accordingly, a stable DC voltage is provided regardless the variances of the load condition and the input voltage of the voltage regulator.

A disadvantage of the conventional voltage regulator is that the operating temperature is too high when the input voltage is high. Another disadvantage of the conventional voltage regulator is that a voltage drop $V_D$ of the pass transistor 10 and the output current $I_O$ inevitably generate a power consumption $P_D$. The power consumption $P_D$ causes an increment of the operating temperature of the voltage regulator. Since the operating temperature significantly impacts the lifespan of the voltage regulator, in order to improve its reliability, the operating temperature must be reduced as much as possible. Packaging process is also another factor to impact the operating temperature of the voltage regulator. It determines the thermo resistance and limits the thermo radiation. However, the packaging process with lower thermo resistance leads to a higher cost.

SUMMARY OF THE INVENTION

It is an object of the present invention to provide a current sharing apparatus, in which the currents to be output are automatically regulated by a plurality of current sharing apparatus connected in parallel with each other in order to reduce an operating temperature of the current sharing apparatuses.

It is another object of the present invention to provide a current sharing method for automatically regulating the currents to be output by using a plurality of current sharing apparatuses connected in parallel with each other to reduce the operating temperature of the current sharing apparatuses.

The present invention provides a current sharing apparatus. The current sharing apparatus comprises an input terminal, an output terminal, a current-sharing control terminal, a pass transistor, a constant voltage generating unit, a feedback control circuit and a current-sharing control unit. The current-sharing control terminal provides a current-sharing control interface. The pass transistor receives an input voltage from the input terminal and provides an output voltage and an output current to the output terminal of the current sharing apparatus. In addition, a reference voltage is generated by the constant voltage generating unit. The feedback control circuit electrically coupled to the output terminal of the current-sharing apparatus and the pass transistor senses the output current for providing a current-sense signal and regulates a control signal of the pass transistor in response to the reference signal for controlling the output of the current sharing apparatus. In addition, the current-sharing control unit electrically coupled to the current-sharing control terminal of the current-sharing apparatus and the feedback control circuit generates a bus signal in response to the current-sense signal and the reference voltage, and generates a reference signal in response to the reference voltage, the bus signal, and the current-sense signal.

In the current sharing apparatus according to a preferred embodiment of the present invention, the feedback control circuit mentioned above comprises a current sensing unit, a voltage divider and an amplifier. The current sensing unit electrically coupled to the pass transistor senses the output current and generates a current-sense signal in response to the output current. In addition, the voltage divider electrically coupled to the output terminal divides the output voltage and generates a feedback voltage in response to the output voltage. A positive terminal of the amplifier is electrically coupled to the voltage divider for receiving the feedback voltage. A negative terminal of the amplifier receives a reference signal. An output terminal of the amplifier provides a control signal to control the pass transistor.

In the current sharing apparatus according to the preferred embodiment of the present invention, the current-sharing control unit mentioned above comprises a pull-up voltage unit, a pull-up resistor, a current generating unit, an input unit, an output unit and a regulating unit. The pull-up voltage unit generates a pull-up voltage in response to the reference voltage. The pull-up resistor is electrically coupled between the pull-up voltage unit and the current-sharing control terminal. The current generating unit generates a first current signal and a second current signal in response to the current-sense signal. In addition, the input unit electrically coupled to the current-sharing control terminal generates a third current signal in response to the pull-up voltage and the bus signal. The output unit electrically coupled to the current-sharing control terminal generates a bus signal in response to the second current signal and the pull-up voltage. Moreover, the regulating unit electrically coupled to the input unit and the current generating unit generates and regulates the reference signal in response to the reference voltage, the first current signal and the third current signal.

The present invention provides a current sharing apparatus. The current sharing apparatus comprises an input terminal, an output terminal, a current-sharing control terminal, a pass transistor, a feedback control circuit and a current-sharing control unit. The current-sharing control terminal provides a current-sharing control interface. The pass transistor receives an input voltage from the input terminal and provides an output voltage and an output current to the output terminal of the current sharing apparatus. In addition, the feedback control circuit electrically coupled to the output terminal of the current-sharing apparatus regulates and provides a control signal to the pass transistor in response to the reference signal for controlling the output of the current sharing apparatus. In addition, the current-sharing control unit electrically coupled to the current-sharing control terminal of the current sharing apparatus and the feedback control circuit generates a reference signal in order to regulate the control signal.

The present invention provides a current sharing apparatus. The current sharing apparatus comprises an input terminal, an output terminal, a current-sharing control terminal, an output apparatus, a feedback control circuit and a current-sharing control unit. The output apparatus provides an output voltage and an output current to the output terminal of the current sharing apparatus. The feedback control circuit electrically coupled to the output terminal and the output apparatus senses the output current and provides a current-sense signal in response to the output current, and regulates and provides a control signal to the output apparatus in response to the reference signal for controlling the output of the current sharing apparatus. In addition, the current-sharing control unit electrically coupled to the current-sharing control terminal and the feedback control circuit generates a bus signal in response to the current-sense signal and the reference voltage and generates a reference signal in response to the reference voltage, the bus signal and the current-sense signal.

The present invention proposes a current sharing method for automatically regulating the currents output from a plurality of current sharing apparatuses connected in parallel with each other to provide an overall output with a current sharing mechanism. The current sharing method comprises steps of: having the current-sharing control terminal of each current sharing apparatus be electrically coupled with each other; having each current sharing apparatus transmit the bus signal with each other via the current-sharing control terminal in response to a respective output state of each current sharing apparatus; and having each current sharing apparatus to regulate its respective output in response to its output state and the bus signal from the current-sharing control terminal, such that the overall output is provided by the current sharing mechanism.

In the current sharing method according to the preferred embodiment of the present invention, having each current sharing apparatus transmit the bus signal with each other via the current-sharing control terminal in response to its respective output state comprises steps of: providing a reference voltage; having each current sharing apparatus sense its respective output current; and having each current sharing apparatus to generate the bus signal in response to the reference voltage and a result of sensing its output current. Moreover, having each current sharing apparatus regulate its respective output in response to its output state and the bus signal comprises steps of: providing a reference voltage; having each current sharing apparatus to generate a respective reference signal in response to its output state, the reference voltage and the bus signal; having each current sharing apparatus regulate and generate a respective control signal in response to its output state and the reference signal; and having each current sharing apparatus regulate and generate a respective output voltage and a respective output current in response to the respective control signal, in which the output voltage and the output current are the output of the current sharing apparatus.

A plurality of current sharing apparatuses connected in parallel with each other is applied in the present invention to share the overall output current of the current sharing apparatus. Consequently, the output current of each current sharing apparatus is reduced, and the operating temperature of each current sharing apparatus is reduced accordingly. In addition, each current sharing apparatus can automatically sense its output state to provide the bus signal via the current-sharing control terminal in response to its respective output state. Accordingly, each current sharing apparatus can automatically regulate its output current in response to the bus signal from the current-sharing control terminal, such that the object of current sharing is achieved.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

An automatic current-sharing control function of the present invention achieved by a current-sharing control terminal of a current sharing apparatus is described with reference to the embodiments hereinafter. For easy explanation, in the following embodiments, a voltage regulator is worked as a current sharing apparatus, and a voltage regulating apparatus composed of a plurality of voltage regulators connected in parallel with each other is exemplified herein to describe the preferred embodiment of the present invention.

Figure 1:
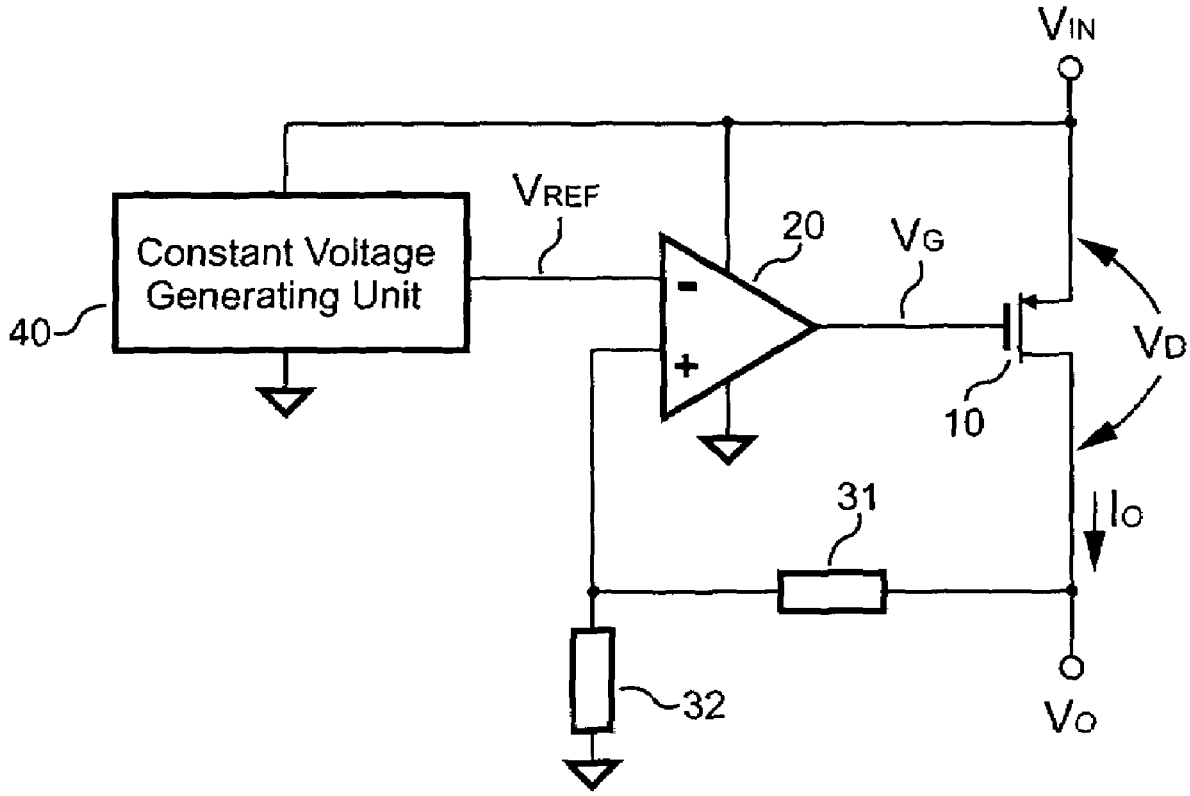
FIG. 1 (Prior Art)
FIG. 1 schematically shows a circuit diagram of a conventional voltage regulator.
Figure 2:
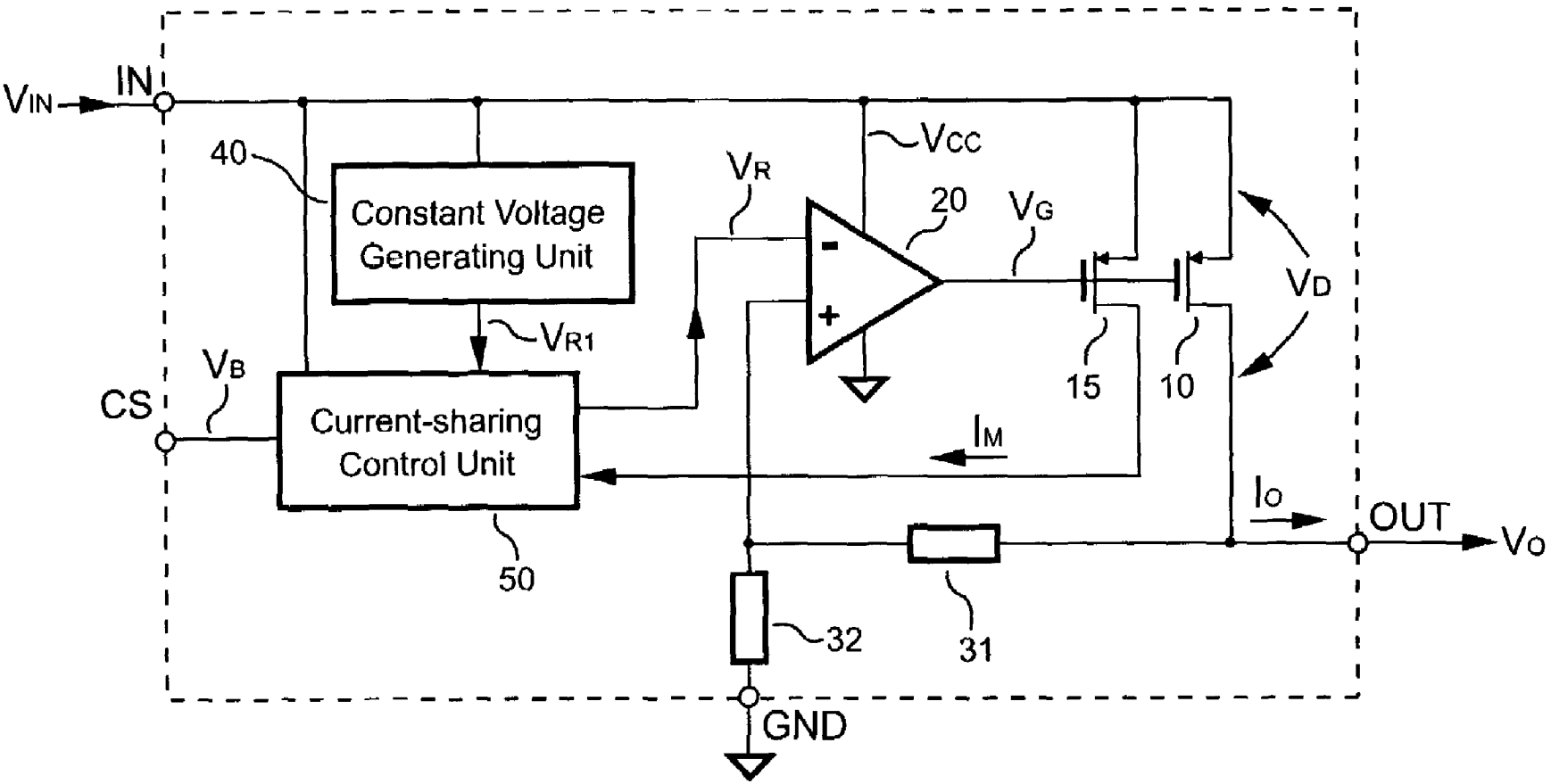
FIG. 2 schematically shows a voltage regulator having current-sharing control function according to a preferred embodiment of the present invention.

FIG. 2 schematically shows a voltage regulator having current-sharing control function according to a preferred embodiment of the present invention. Referring to FIG. 2, the voltage regulator comprises an input terminal IN, an output terminal OUT, and a current-sharing control terminal CS. The current-sharing control terminal CS provides a current-sharing control interface. An output apparatus (e.g. a pass transistor 10) receives an input voltage $V_{IN}$ from the input terminal IN; regulates an output voltage $V_O$ and an output current $I_O$ in response to a control signal $V_G$; and outputs the output voltage $V_O$ and the output current $I_O$ through the output terminal OUT. In addition, a constant voltage generating unit 40 generates a reference voltage $V_{R1}$.

The feedback control circuit electrically coupled to the output terminal OUT and the pass transistor 10 senses the output current $I_O$ to generate a current-sense signal $I_M$. The feedback control circuit further provides the control signal $V_G$ to the pass transistor 10 in response to a reference signal $V_R$ for output regulation of the voltage regulator. In addition, the feedback control circuit comprises a voltage divider and an amplifier 20 (e.g. an error amplifier). The voltage divider electrically coupled to the output terminal OUT divides the output voltage $V_O$ and generates a feedback voltage. The voltage divider is composed of resistors 31 and 32 connected in series between the output terminal OUT and the ground reference GND. A positive terminal of the amplifier 20 electrically coupled to the voltage divider receives the feedback voltage, and a negative terminal of the amplifier 20 receives the reference signal $V_R$. The control signal $V_G$ is provided from an output terminal of the amplifier 20 to control the pass transistor 10 and the output of the voltage regulator. A current-sensing unit electrically coupled to the pass transistor 10 generates a current-sense signal $I_M$ in response to the output current $I_O$. The current-sensing unit is, for example, a transistor 15, which forms a current mirror with the pass transistor 10. Therefore, a drain of the transistor 15 generates the current-sense signal $I_M$ in proportion to the output current $I_O$.

A current-sharing control unit electrically coupled to the current-sharing control terminal CS, the constant voltage generating unit 40 and the feedback control circuit provides a bus signal $V_B$ to the current-sharing control terminal CS in response to the current-sense signal $I_M$ and the reference voltage $V_{R1}$. The bus signal $V_B$ represents the current level of the output current $I_O$. In addition, the current-sharing control unit 50 further generates the reference signal $V_R$ in response to the reference voltage $V_{R1}$, the bus signal $V_B$ from the current-sharing control terminal CS and the current-sense signal $I_M$. Finally, the voltage regulator generates the control signal $V_G$ in response to the reference signal $V_R$ to regulate the output of the voltage regulator.

Figure 3:
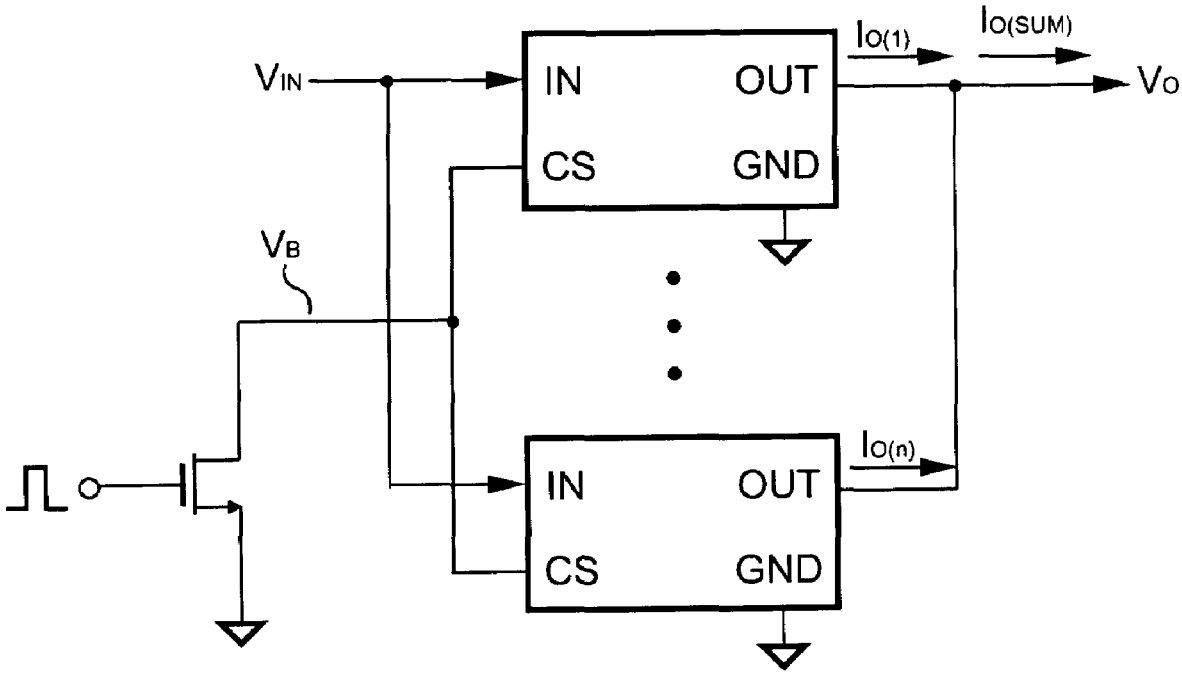
FIG. 3 schematically shows a voltage regulating apparatus composed of a plurality of voltage regulators connected in parallel according to a preferred embodiment of the present invention.

FIG. 3 schematically shows a voltage regulating apparatus composed of multiple voltage regulators connected in parallel according to a preferred embodiment of the present invention. Referring to FIG. 3, the voltage regulating apparatus comprises a plurality of voltage regulators connected in parallel with each other. Each voltage regulator has an input terminal IN, an output terminal OUT and a current-sharing control terminal CS. The input terminals IN of each voltage regulator commonly receive the input voltage $V_{IN}$ of the voltage regulating apparatus. The output terminals OUT of each voltage regulator commonly provide the output voltage $V_O$ of the voltage regulating apparatus, such that an overall output current $I_{O(SUM)}$ is shared with each other. The current-sharing control terminals CS of each voltage regulator are electrically coupled with each other, such that the respective current-sharing control terminal CS automatically controls a current-sharing ratio for each voltage regulator. In addition, the voltage regulator having a maximum output current dominates the bus signal $V_B$ and is defined as a master voltage regulator. Others are defined as the auxiliary voltage regulators, which track the bus signal $V_B$ to share the overall output current $I_{O(SUM)}$.

Figure 4:
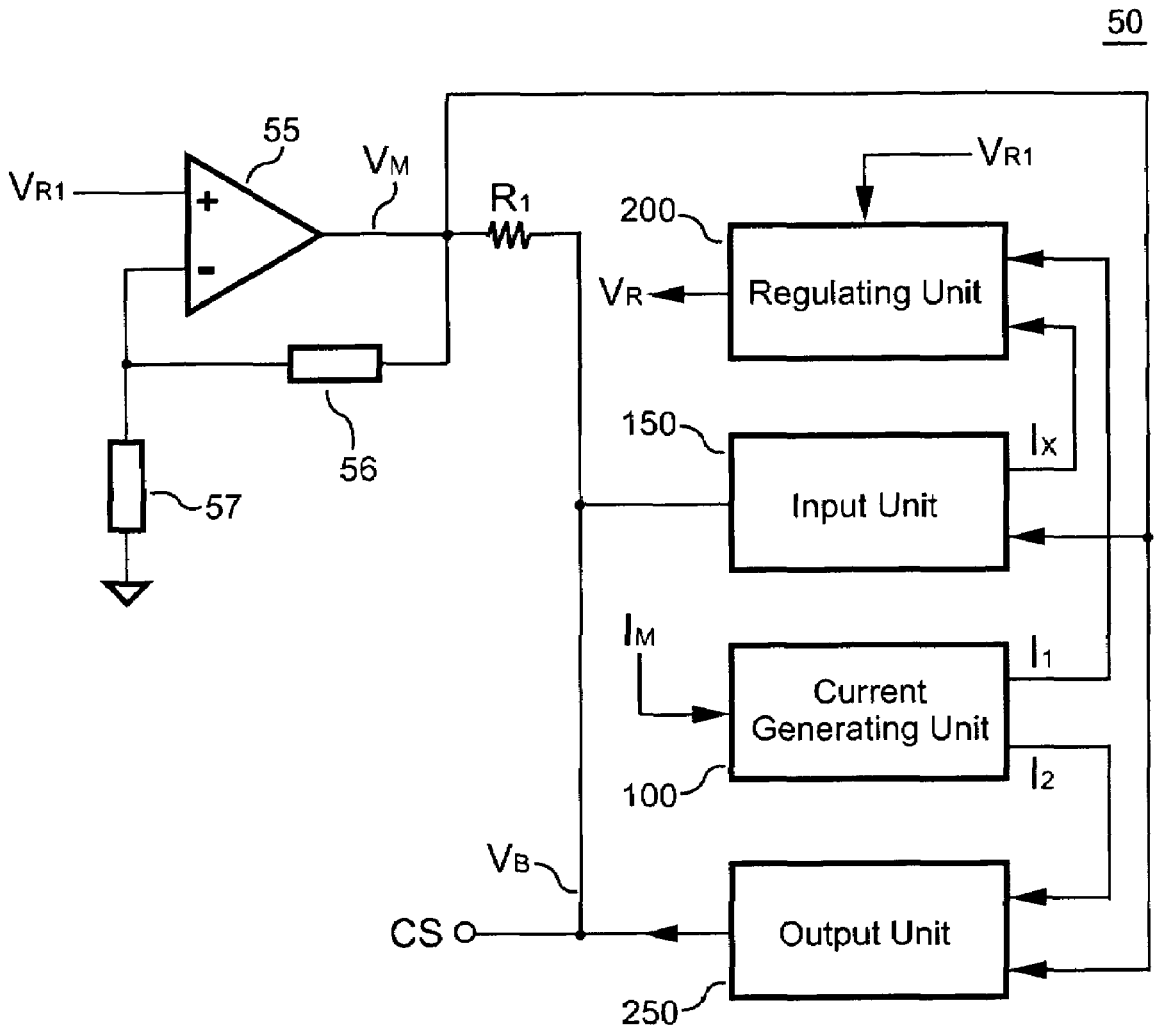
FIG. 4 schematically shows a current-sharing control unit according to a preferred embodiment of the present invention.

FIG. 4 schematically shows a current-sharing control unit 50 according to a preferred embodiment of the present invention. The current-sharing control unit 50 comprises a pull-up voltage unit, a pull-up resistor $R_1$, a current generating unit 100, an input unit 150, an output unit 250 and a regulating unit 200. The pull-up voltage unit composed of an operational amplifier (OP AMP) 55 and resistors 56 and 57 generates a pull-up voltage $V_M$ in response to the reference voltage $V_{R1}$. The reference voltage $V_{R1}$ is electrically coupled to a positive terminal of the OP AMP 55. The pull-up resistor $R_1$ is electrically coupled between the pull-up voltage unit and the current-sharing control terminal CS. In addition, the current generating unit 100 generates a first current signal $I_1$ and a second current signal $I_2$ in response to the current-sense signal $I_M$. The input unit 150 electrically coupled to the current-sharing control terminal CS generates a third current signal $I_X$ in response to the pull-up voltage $V_M$ and the bus signal $V_B$. The output unit 250 electrically coupled to the current-sharing control terminal CS generates the bus signal $V_B$ in response to the second current signal $I_2$ and the pull-up voltage $V_M$. The regulating unit 200 electrically coupled to the constant voltage generating unit 40, the current generating unit 100 and the input unit 150 generates and regulates the reference signal $V_R$ in response to the reference voltage $V_{R1}$, the first current signal $I_1$ and the third current signal $I_X$.

Figure 5:
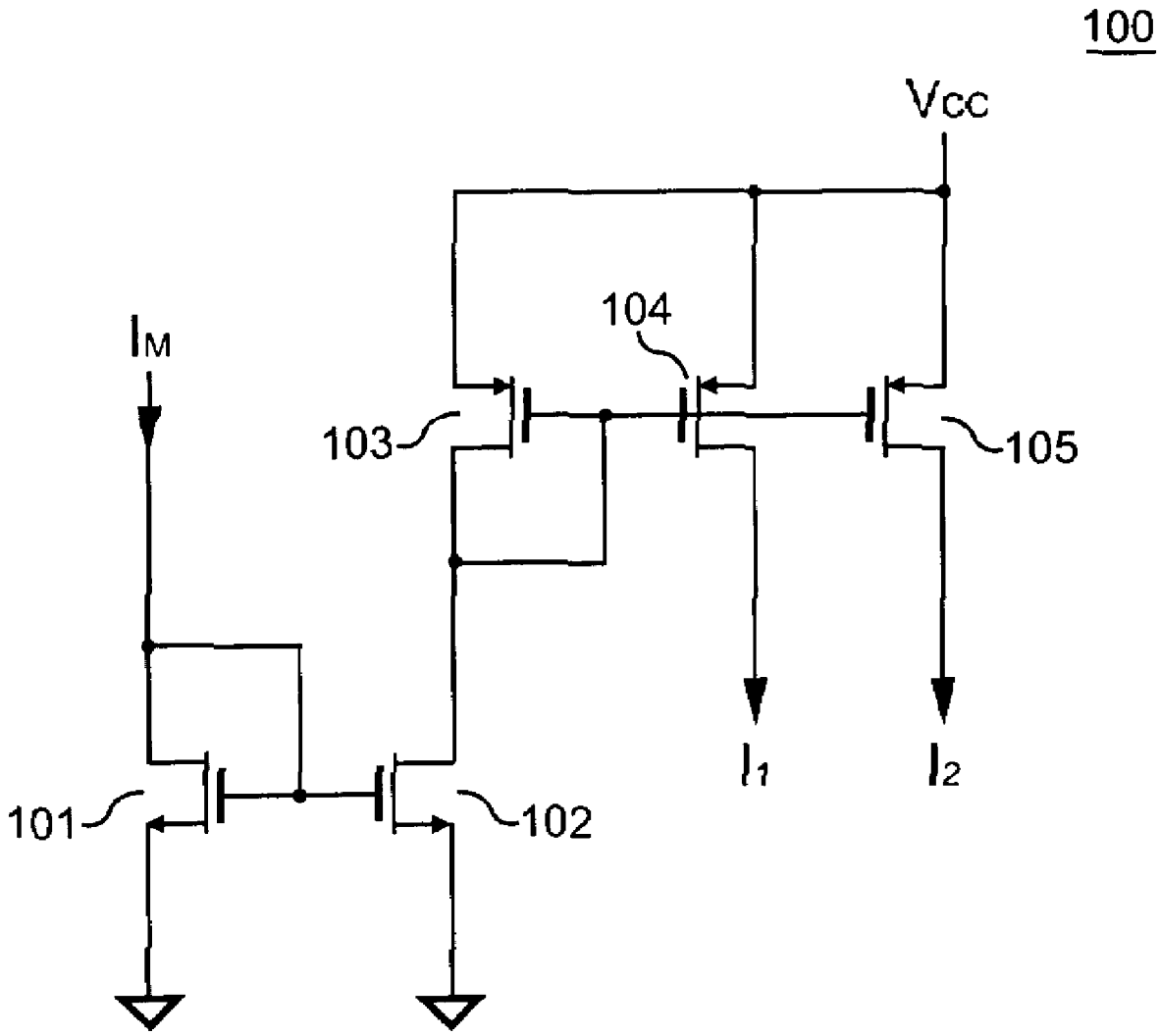
FIG. 5 schematically shows a current generating unit according to a preferred embodiment of the present invention.

FIG. 5 schematically shows the current generating unit 100 according to a preferred embodiment of the present invention. Transistors 101, 102, 103, 104 and 105 form a current mirror, which generates the first current signal $I_1$ and the second current signal $I_2$ in response to the current-sense signal $I_M$.

Figure 6:
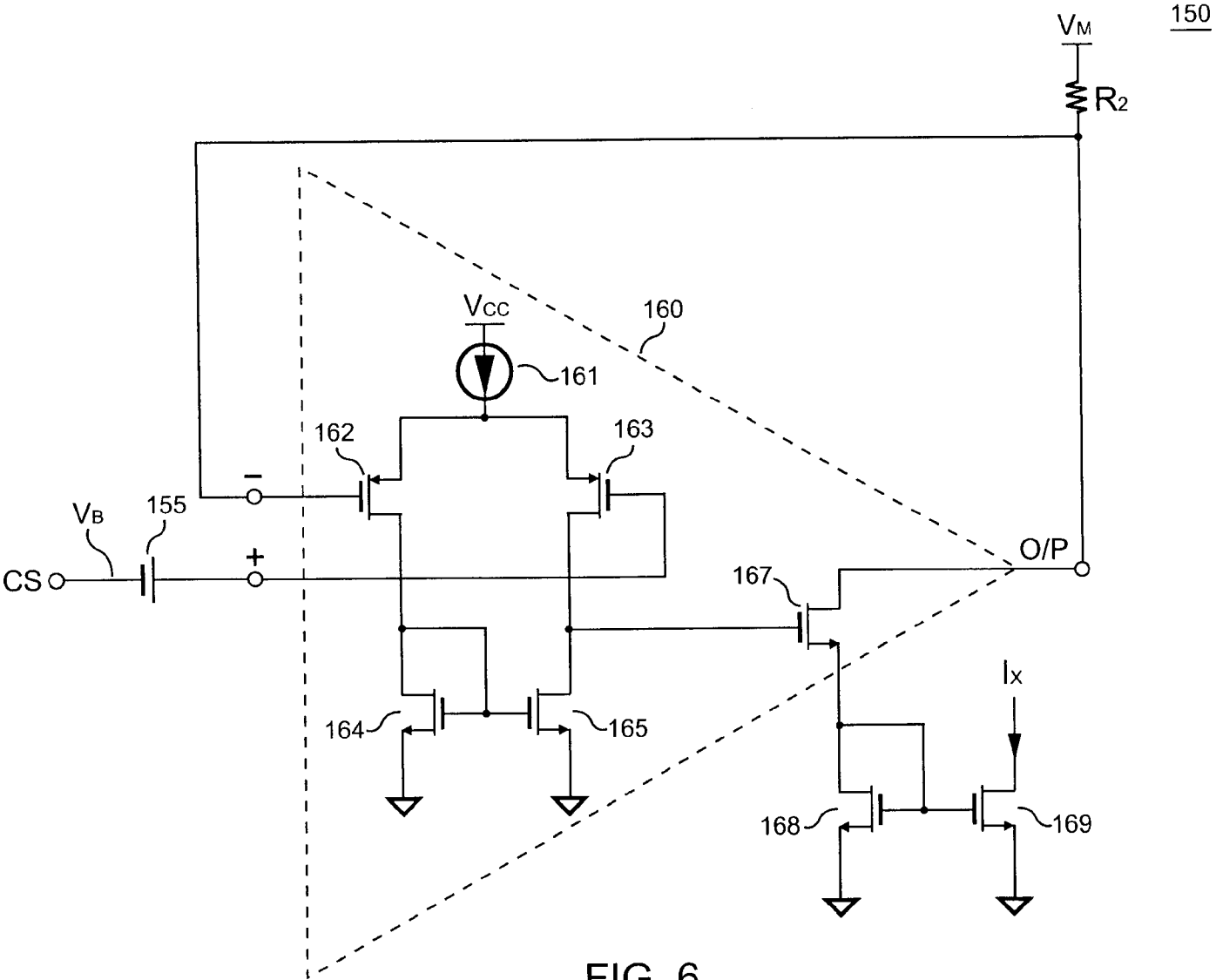
FIG. 6 schematically shows an input unit according to a preferred embodiment of the present invention.

FIG. 6 schematically shows the input unit 150 according to a preferred embodiment of the present invention. Referring to FIG. 6, the input unit 150 comprises an input resistor $R_2$ and a buffer amplifier 160. The buffer amplifier 160 has a first output terminal O/P and a second output terminal. A positive input terminal of the buffer amplifier 160 is provided with an offset voltage 155 and electrically coupled to the current-sharing control terminal CS for receiving the bus signal $V_B$. A negative input terminal of the buffer amplifier 160 is electrically coupled to the first output terminal O/P. The first output terminal O/P is further coupled to the pull-up voltage $V_M$ via the input resistor $R_2$. The second output terminal of the buffer amplifier 160 generates the third current signal $I_X$ in response to the pull-up voltage $V_M$, the bus signal $V_B$, the offset voltage 155 and the input resistor $R_2$.

A current source 161 and the transistors 162, 163, 164 and 165 form a differential input stage of the buffer amplifier 160. A transistor 167 is electrically coupled between the transistor 165 and the first output terminal O/P of the buffer amplifier 160. The transistors 168 and 169 form a current mirror. The transistor 168 is electrically coupled to the transistor 167 to receive a current from the first output terminal O/P of the buffer amplifier 160. In addition, the third current signal $I_X$ is provided by a transistor 169, such that the third current signal $I_X$ is in direct proportion to the current from the first output terminal O/P of the buffer amplifier 160. The third current signal $I_X$ is represented by Equation (1) as follows.

$$I_X = k_1 \times \frac{V_M - (V_B + V_{offset})}{R_2} \quad (1)$$

Wherein, $k_1$ is a current mirror ratio between the transistors 168 and 169, and $V_{offset}$ is the voltage value of the offset voltage 155.

Figure 7:
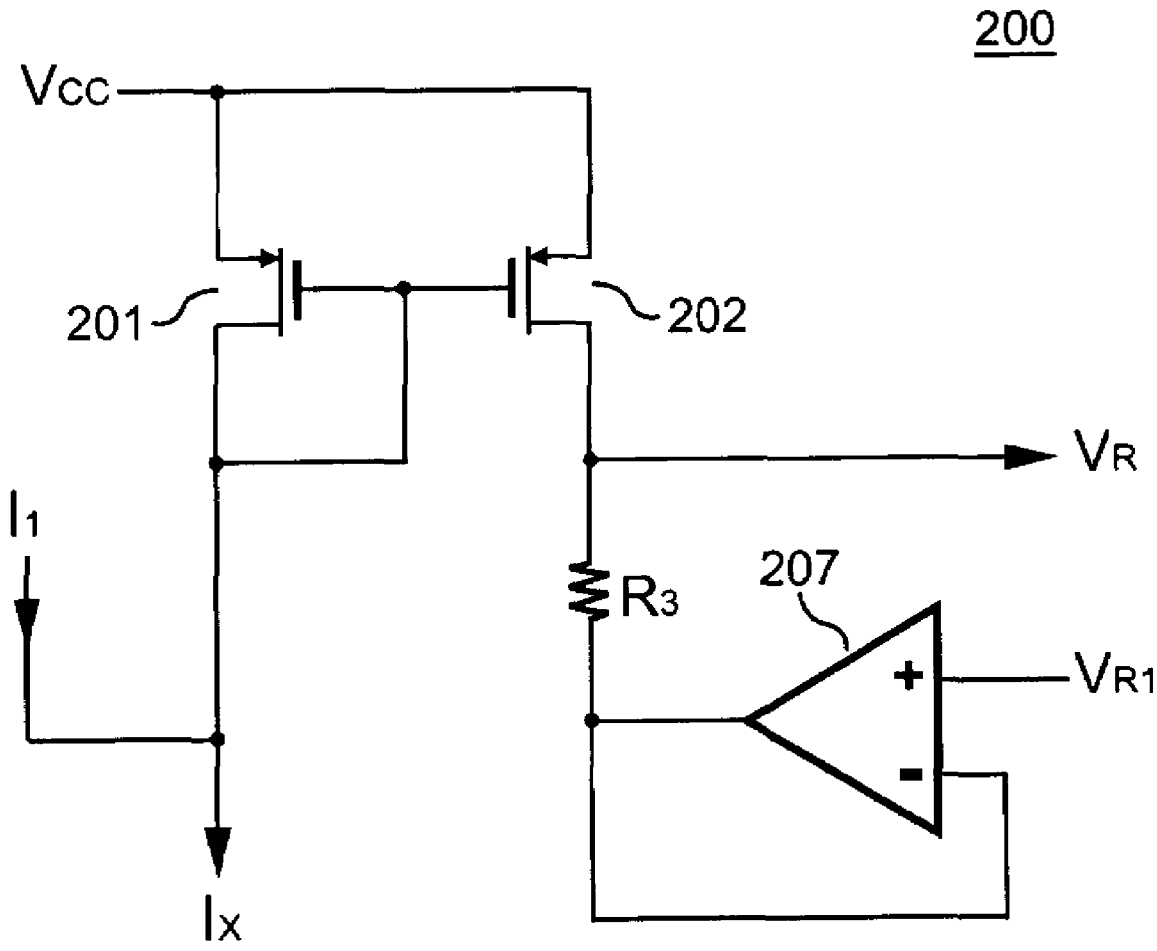
FIG. 7 schematically shows a regulating unit according to a preferred embodiment of the present invention.

FIG. 7 schematically shows a regulating unit 200 according to a preferred embodiment of the present invention. Referring to FIG. 7, the regulating unit 200 comprises a regulating current mirror composed of transistors 201 and 202, a regulating resistor $R_3$ and an unit-gain buffer 207. The first current signal $I_1$ and the third current signal $I_X$ are both coupled to the transistor 201. The transistor 202 generates a regulating current signal in response to the first current signal $I_1$ and the third current signal $I_X$. The regulating resistor $R_3$ electrically coupled to the transistor 202 receives the regulating current signal and generates the reference signal $V_R$. In addition, an input terminal of the unit-gain buffer 207 receives the reference voltage $V_{R1}$, and an output terminal of the unit-gain buffer 207 is electrically coupled to the regulating resistor $R_3$. The reference signal $V_R$ is represented by Equation (2) as follows.

$$V_R = V_{R1} + [k_2 \times (I_x - I_1)] \times R_3 \quad (2)$$

Wherein, $k_2$ is a current mirror ratio between the transistors 201 and 202.

Figure 8:
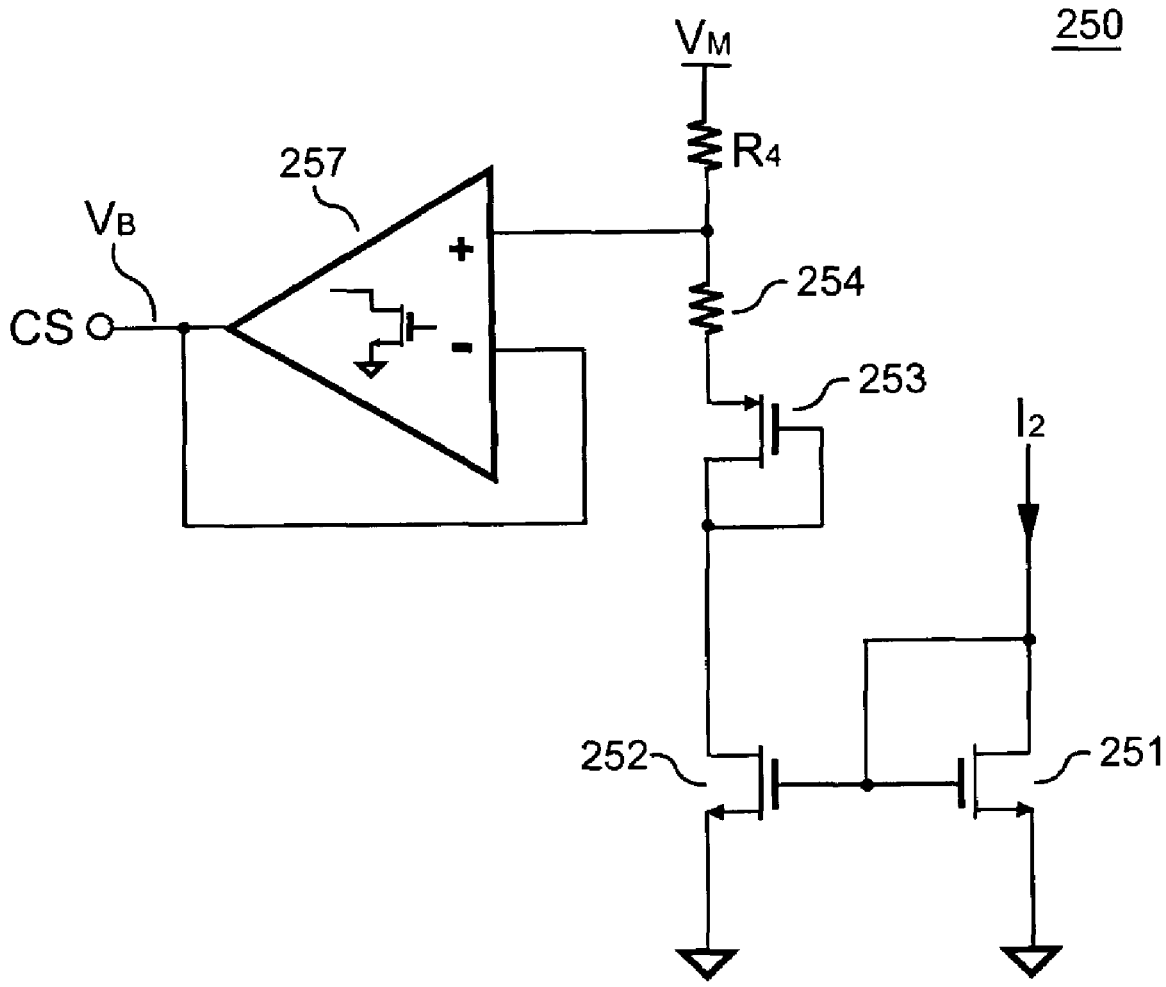
FIG. 8 schematically shows an output unit according to a preferred embodiment of the present invention.

FIG. 8 schematically shows the output unit 250 according to a preferred embodiment of the present invention. Referring to FIG. 8, the output unit 250 comprises an output resistor $R_4$, a resistor 254, a equivalent diode formed by the transistor 253, a unit-gain amplifier 257 and an output current mirror composed of two transistors 251 and 252. The unit-gain amplifier 257 has an open-collector (or an open-drain) output structure. An output terminal of the unit-gain amplifier 257 is electrically coupled to the current-sharing control terminal CS for generating the bus signal $V_B$. A negative terminal of the unit-gain amplifier 257 is electrically coupled to the output terminal thereof, and a positive terminal of the unit-gain amplifier 257 is electrically coupled to the pull-up voltage $V_M$ via the output resistor $R_4$. The transistor 252 is electrically coupled to the positive terminal of the unit-gain amplifier 257 via the transistors 253 and the resistor 254. The transistor 251 receives the second current signal $I_2$ from the current generating unit 100. Thus, a voltage drop is generated across the output resistor $R_4$ in response to the second current signal $I_2$. Accordingly, the bus signal $V_B$ is generated in response to the second current signal $I_2$, the output resistor $R_4$ and the pull-up voltage $V_M$. Wherein, the bus signal $V_B$ is represented by Equation (3) as follows.

$$V_B = V_M - k_3 \times I_2 \times R_4 \quad (3)$$

Wherein, $k_3$ is a current mirror ratio between the transistors 251 and 252.

Referring to Equation (3), it is obvious that the bus signal $V_B$ is regulated in response to the output current $I_O$ of the voltage regulator. Since the output terminal of the unit-gain amplifier 257 is the open-collector (or the open-drain) structure, the bus signal $V_B$ is pulled down by the unit-gain amplifier 257, such that the current-sharing control terminals CS are connected in parallel with each other. As shown in FIG. 3, if no load existed, the pull-up voltage $V_M$ regulates a maximum voltage of the bus signal $V_B$. The voltage regulator having maximum output current dominates the bus signal $V_B$. The voltage regulator dominating the bus signal $V_B$ is defined as a master voltage regulator. Other voltage regulators (i.e. the auxiliary voltage regulators) continuously track the bus signal $V_B$ so as to share the overall output current $I_{O(SUM)}$. The auxiliary voltage regulators generate the third current signal $I_X$ according to Equation (1). In addition, the offset voltage $V_{offset}$ determines an initial threshold. When the bus signal $V_B$ is higher than the offset voltage $V_{offset}$, the auxiliary voltage regulators start to generate the third current signal $I_X$ and cooperate with the master voltage regulator to share the overall output current $I_{O(SUM)}$. A lower bus signal $V_B$ generates a higher third current signal $I_X$. Finally, the object of current sharing is achieved by increasing the output voltage $V_O$ of the auxiliary voltage regulators. The output voltage $V_O$ is determined by the reference signal $V_R$ and represented by Equation (4) as follows.

$$V_O = \frac{R_{31} + R_{32}}{R_{32}} \times V_R \quad (4)$$

Wherein, $R_{31}$ and $R_{32}$ are the resistance values of the resistors 31 and 32, respectively.

Equation (2) indicates that the reference signal $V_R$ is regulated by the third current signal $I_X$ and the first current signal $I_1$, wherein the first current signal $I_1$ relatively represents the output current $I_O$ of the voltage regulator. When the third current signal $I_X$ is greater than the first current signal $I_1$, the reference signal $V_R$ is increased, which also increases the output current $I_O$. Finally, after the output current $I_O$ is increased, the increasing amount of the reference signal $V_R$ is converged. With the bus signal $V_B$ transmitted with each other between the current-sharing control terminals CS, the output current of the master voltage regulator is reduced by the increasing amount of the output current of the auxiliary voltage regulators, such that the object of current sharing is achieved.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A current sharing apparatus, comprising:

an input terminal;

an output terminal;

a current-sharing control terminal, providing a current-sharing control interface;

a pass transistor, having a first terminal, a second terminal, and a third terminal, said first terminal being electrically coupled to said input terminal for receiving an input voltage, said second terminal being electrically coupled to said output terminal for providing an output voltage and an output current to said output terminal;

a constant voltage generating unit, generating a reference voltage;

a feedback control circuit, being electrically coupled to said output terminal and said pass transistor for sensing said output current to provide a current-sense signal, said feedback control circuit regulating and providing a control signal to said third terminal of said pass transistor in response to a reference signal in order to control an output of said current sharing apparatus; and a current-sharing control unit, being electrically coupled to said current-sharing control terminal and said feedback control circuit for generating a bus signal in response to said current-sense signal and said reference voltage, said current-sharing control unit generating said reference signal in response to said reference voltage, said bus signal, said current-sense signal.

2. The current sharing apparatus of claim 1, wherein said feedback control circuit comprises:

a current-sensing unit, being electrically coupled to said pass transistor for sensing said output current to generate said current-sense signal;

a voltage divider, being electrically coupled to said output terminal for dividing said output voltage to generate a feedback voltage; and an amplifier, having a positive terminal electrically coupled to said voltage divider for receiving said feedback voltage, a negative terminal receiving said reference signal, and an output terminal outputting said control signal for controlling said pass transistor.

3. The current sharing apparatus of claim 1, wherein said current-sharing control unit comprises:

a pull-up voltage unit, generating a pull-up voltage in response to said reference voltage;

a pull-up resistor, being electrically coupled between said pull-up voltage unit and said current-sharing control terminal;

a current generating unit, generating a first current signal and a second current signal in response to said current-sense signal;

an input unit, being electrically coupled to said current-sharing control terminal for generating a third current signal in response to said pull-up voltage and said bus signal;

an output unit, being electrically coupled to said current-sharing control terminal for generating said bus signal in response to said second current signal and said pull-up voltage; and a regulating unit, being electrically coupled to said input unit and said current generating unit for generating and regulating said reference signal in response to said reference voltage, said first current signal, and said third current signal.

4. The current sharing apparatus of claim 3, wherein said input unit comprises:

an input resistor, having a first terminal electrically coupled to said pull-up voltage; and a buffer amplifier, having a positive terminal provided with an offset voltage and being electrically coupled to said current-sharing control terminal for receiving said bus signal, wherein a negative terminal of said buffer amplifier is electrically coupled to a first output terminal of said buffer amplifier and a second terminal of said input resistor, and a second output terminal of said buffer amplifier generates said third current signal in response to said pull-up voltage, said bus signal, said offset voltage, and said input resistor.

5. The current sharing apparatus of claim 3, wherein said output unit comprises:

an output resistor, having a first terminal electrically coupled to said pull-up voltage;

a unit-gain amplifier, having a positive terminal electrically coupled to a second terminal of said output resistor, said unit-gain amplifier having an output terminal electrically coupled to said current-sharing control terminal and a negative terminal of said unit-gain amplifier for generating said bus signal, wherein said output terminal of said unit-gain amplifier is an open-collector structure; and an output current mirror, being electrically coupled to said positive terminal of said unit-gain amplifier for generating a voltage drop across said output resistor in response to said second current signal; wherein said bus signal is generated in response to said second current signal, said output resistor, and said pull-up voltage.

6. The current sharing apparatus of claim 3, wherein said regulating unit comprises:

a regulating current mirror, generating a regulating current signal in response to said first current signal and said third current signal;

a regulating resistor, receiving said regulating current signal to generate said reference signal; and a unit-gain buffer, having an input terminal receiving said reference voltage, and an output terminal electrically coupled to said regulating resistor.

7. The current sharing apparatus of claim 1, wherein said current sharing apparatus is a voltage regulator.

8. A current sharing apparatus, comprising:

an input terminal;

an output terminal;

a current-sharing control terminal, providing a current-sharing control interface;

a pass transistor, having a first terminal, a second terminal, and a third terminal, said first terminal being electrically coupled to said input terminal for receiving an input voltage, said second terminal being electrically coupled to said output terminal for providing an output voltage and an output current to said output terminal;

a feedback control circuit, being electrically coupled to said output terminal for regulating and providing a control signal to said third terminal of said pass transistor in response to a reference signal in order to control an output of said current sharing apparatus; and a current-sharing control unit, being electrically coupled to said current-sharing control terminal and said feedback control circuit for generating said reference signal and regulating said control signal.

9. The current sharing apparatus of claim 8, further comprising a current-sensing unit electrically coupled to said pass transistor for sensing said output current and generating a current-sense signal.

10. The current sharing apparatus of claim 8, wherein said current-sharing control unit is electrically coupled to said current-sharing control terminal for generating a bus signal in response to said output current, and said current-sharing control unit further generates said reference signal in response to a reference voltage, said bus signal, and said output current.

11. The current sharing apparatus of claim 8, wherein said feedback control circuit comprises:

a voltage divider, being electrically coupled to said output terminal for dividing said output voltage to generate a feedback voltage in response to said output voltage; and an amplifier, having a positive terminal electrically coupled to said voltage divider for receiving said feedback voltage, a negative terminal receiving said reference signal, and an output terminal outputting said control signal for controlling said pass transistor.

12. The current sharing apparatus of claim 9, wherein said current-sharing control unit comprises:

a pull-up voltage unit, generating a pull-up voltage in response to said reference voltage;

a pull-up resistor, being electrically coupled between said pull-up voltage unit and said current-sharing control terminal;

a current generating unit, generating a first current signal and a second current signal in response to said current-sense signal;

an input unit, being electrically coupled to said current-sharing control terminal for generating a third current signal in response to said pull-up voltage and said bus signal;

an output unit, being electrically coupled to said current-sharing control terminal for generating said bus signal in response to said second current signal and said pull-up voltage; and a regulating unit, being electrically coupled to said input unit and said current generating unit for generating and regulating said reference signal in response to said reference voltage, said first current signal, and said third current signal.

13. The current sharing apparatus of claim 12, wherein said input unit comprises:

an input resistor, having a first terminal being electrically coupled to said pull-up voltage; and a buffer amplifier, having a positive terminal provided with an offset voltage and being electrically coupled to said current-sharing control terminal for receiving said bus signal, wherein a negative terminal of said buffer amplifier is electrically coupled to a first output terminal and a second terminal of said input resistor, and a second output terminal of said buffer amplifier generates said third current signal in response to said pull-up voltage, said bus signal, said offset voltage, and said input resistor.

14. The current sharing apparatus of claim 12, wherein said output unit comprises:

an output resistor, having a first terminal electrically coupled to said pull-up voltage;

a unit-gain amplifier, having a positive terminal electrically coupled to a second terminal of said output resistor, an output terminal electrically coupled to said current-sharing control terminal and a negative terminal of said unit-gain amplifier for generating said bus signal, wherein said output terminal of said unit-gain amplifier is an open-collector structure; and an output current mirror, electrically coupled to said positive terminal of said unit-gain amplifier for generating a voltage drop across said output resistor in response to said second current signal; wherein said bus signal is generated in response to said second current signal, said output resistor, and said pull-up voltage.

15. The current sharing apparatus of claim 12, wherein said regulating unit comprises:

a regulating current mirror, for generating a regulating current signal in response to said first current signal and said third current signal;

a regulating resistor, for receiving said regulating current signal to generate said reference signal; and a unit-gain buffer, having an input terminal receiving said reference voltage, and an output terminal electrically coupled to said regulating resistor.

16. A current sharing apparatus, comprising:

an input terminal;

an output terminal;

a current-sharing control terminal;

an output apparatus, for providing an output voltage and an output current to said output terminal;

a feedback control circuit, being electrically coupled to said output terminal and said output apparatus for sensing said output current to provide a current-sense signal, said feedback control circuit regulating and providing a control signal to said output apparatus in response to a reference signal in order to control an output of said current sharing apparatus; and a current-sharing control unit, being electrically coupled to said current-sharing control terminal and said feedback control circuit for generating a bus signal in response to said current-sense signal and said reference voltage, and generating said reference signal in response to said reference voltage, said bus signal, and said current-sense signal.

17. The current sharing apparatus of claim 16, wherein said feedback control circuit comprises:

a current-sensing unit, being electrically coupled to said output apparatus for sensing said output current and generating said current-sense signal in response to said output current;

a voltage divider, being electrically coupled to said output terminal of said current sharing apparatus for dividing said output voltage to generate a feedback voltage in response to said output voltage; and an amplifier, having a positive terminal electrically coupled to said voltage divider for receiving said feedback voltage, a negative terminal receiving said reference signal, and an output terminal outputting said control signal for controlling said output apparatus.

18. The current sharing apparatus of claim 16, wherein said current-sharing control unit comprises:

a pull-up voltage unit, generating a pull-up voltage in response to said reference voltage;

a pull-up resistor, being electrically coupled between said pull-up voltage unit and said current-sharing control terminal;

an input unit, being electrically coupled to said current-sharing control terminal for generating a bias signal in response to said pull-up voltage and said bus signal;

an output unit, being electrically coupled to said current-sharing control terminal for generating said bus signal in response to said current-sense signal and said pull-up voltage; and a regulating unit, generating and regulating said reference signal in response to said reference voltage, said current-sense signal, and said bias signal.

19. A current sharing method for automatically regulating respective outputs of a plurality of current sharing apparatuses connected in parallel with each other to provide an overall output by a current sharing mechanism, comprising:

having a respective current-sharing control terminal of said each current sharing apparatus be electrically coupled with each other;

having said each current sharing apparatus transmit a bus signal with each other through said respective current-sharing control terminal in response to a respective output state of said each current sharing apparatus; and having said each current sharing apparatus regulate said respective output in response to said respective output state and said bus signal from said current-sharing control terminal for providing said overall output by said current sharing mechanism.

20. The current sharing method of claim 19, wherein said each current sharing apparatus is a voltage regulator.

21. The current sharing method of claim 19, wherein having said each current sharing apparatus transmit said bus signal with each other through said respective current-sharing control terminal in response to said respective output state comprises steps of:

providing a reference voltage;

having each current sharing apparatus sense a respective output current; and having each current sharing apparatus generate said bus signal in response to a result of sensing said respective output current and said reference voltage.

22. The current sharing method of claim 19, wherein having said each current sharing apparatus regulate said respective output in response to said respective output state and said bus signal comprises steps of:

providing a reference voltage;

having each current sharing apparatus generate a reference signal in response to said respective output state, said reference voltage, and said bus signal; and having each current sharing apparatus regulate and provide an output voltage and an output current respectively in response to a respective control signal, wherein said output voltage and said output current are said output of said each current sharing apparatus.

* * * * *